United States Patent [19]

Bird

[11] 4,390,113

[45] Jun. 28, 1983

[54] CONTAINER LID HAVING VENT MEANS

[76] Inventor: Stanford W. Bird, 745 E. 3 Fountain Cir. #36, Salt Lake City, Utah 84107

[21] Appl. No.: 353,217

[22] Filed: Mar. 1, 1982

[51] Int. Cl.[3] ..... B65D 41/16; B65D 41/18; B65D 51/16

[52] U.S. Cl. ..... 220/306; 220/366

[58] Field of Search ..... 220/306, 366; 229/43; 150/0.5

[56] References Cited

U.S. PATENT DOCUMENTS

| | | | |
|---|---|---|---|
| 3,061,139 | 10/1962 | Edwards | 220/366 |
| 3,381,872 | 5/1968 | Holder et al. | 220/366 |
| 3,794,090 | 2/1974 | Commisso | 220/366 |
| 3,912,118 | 10/1975 | Bird | 220/306 |
| 4,206,845 | 6/1980 | Christian | 220/366 |
| 4,234,100 | 11/1980 | Chabot | 220/306 |

*Primary Examiner*—George T. Hall

*Attorney, Agent, or Firm*—B. Deon Criddle; Terry M. Crellin

[57] ABSTRACT

A container made of flexible material having a depending container engaging sidewall and a raised top surface. The depending container engaging sidewall is formed with an inner flange having notches spaced around it length and a resilient outer flange with intermittent elongate bead means aligned with the notches of the inner flange and grooves in a shoulder interconnecting the flanges to engage a rolled top of a container. The intermittent bead means hold the lid firmly to the container and the notches and grooves permit steam accumulating in the container to be vented past ends of the bead means and to atmosphere as directed by the outer flange.

1 Claim, 4 Drawing Figures

CONTAINER LID HAVING VENT MEANS

BRIEF DESCRIPTION OF THE INVENTION

1. Field of the Invention

This invention relates to lids for containers intended to hold food items and the like.

2. Prior Art

The prepared, carry-out food business has grown tremendously in recent years. This growth has led to an increased demand for packages for foods that will attractively display the foods while at the same time providing for convenience in handling. Many bucket-type containers have been developed and used in the market of carry-out food items. Such bucket-type containers have frequently been made of cardboard or other easily formed low-cost and grease absorbing material and generally have included a snap-in or snap-on lid of the same or a different material such as plastic. These known lids have frequently been difficult to position on the container or have fallen from the container after being positioned thereon as the container is subjected to normal handling. Some flat snap-end type lids have been difficult to remove.

In my U.S. Pat. No. 3,912,118, I have disclosed a lid for use on such bucket-type containers that will easily seal the container, maintain the seal during normal handling, still be easily removed when desired by the user, and that will additionally function as a serving bowl. In addition, the container lid described in my U.S. Pat. No. 3,912,118 has holes through the upper surface thereof to permit venting of steam from the inside of the container. The holes are provided through bosses that extend into the container lid so that when the lid is used as a serving bowl, grease from the food contained therein will accumulate around the bosses and not fall through the holes.

It has been found, however, that while the venting of the food products is extremely important to prevent the food products from becoming soggy after cooking and during transportation, the holes through the top of the container lid permit food to fall through when the container lid is being used as a serving bowl and do not permit adequate venting when the containers are stacked one on top of another with an upper container blocking venting of the one below.

SUMMARY OF THE INVENTION

Principal objects of the present invention are to provide alif suitable for use on bucket-type food containers and the like that will grip the rolled upper rim of the bucket-type container and that will deform with the container top during carrying and the like while still providing venting of the interior of the container to atmosphere.

Other objects that provide such a lid made of inexpensively formed thermoplastic materials; that will readily snap on to a bucket-type container rim; that will be considerably more difficult to remove from than to install on a container; that will not pop off the container when the container is tipped, squeezed or otherwise handled during usage and that can be used as a serving bowl with a fully closed bottom surface for the bowl.

Principal features of the invention include a flexible sidewall depending from a rim top and having an inner flange with spaced notches therein and a resilient outer flange having intermittent bead members projecting inwardly therefrom. The bead members are spaced opposite the notches of the inner flange and are aligned with grooves formed in a shoulder interconnecting the inner and outer flanges. The inner and outer flanges are respectively adapted to engage inner and outer edges of a roll-top rim of a bucket-type container. The notches and grooves permit steam from within the container to pass through the inner flange and over the rolled edge of the container and the bead members are arranged such that they engage the lower surface of the rolled edge of the container, with the steam then passing downwardly past the ends of the bead members and from beneath the outer flange.

Additional objects and features of the invention will become apparent from the following detailed description taken together with the accompanying drawings.

THE DRAWINGS

FIG. 1 is a side elevation view of a lid of the invention, installed on a bucket-type container;

FIG. 2, a top plan view of the lid;

FIG. 3, a vertical section view taken on the line 3—3 of FIG. 2, with arrows to show steam travel; and FIG. 4, a perspective view looking into the lid and with arrows to show steam travel.

DETAILED DESCRIPTION OF THE DRAWINGS

Referring now to the drawings

Figure 1:
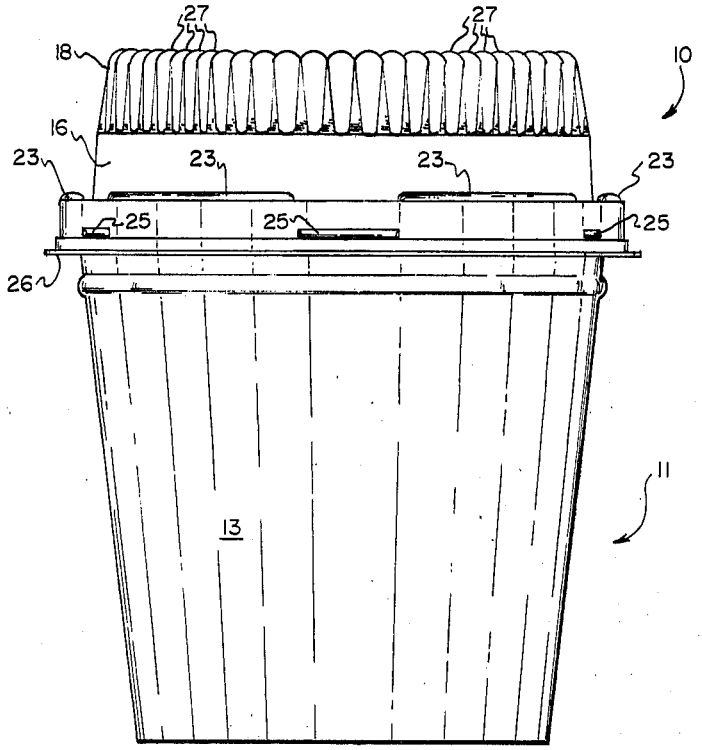
Figure 2:
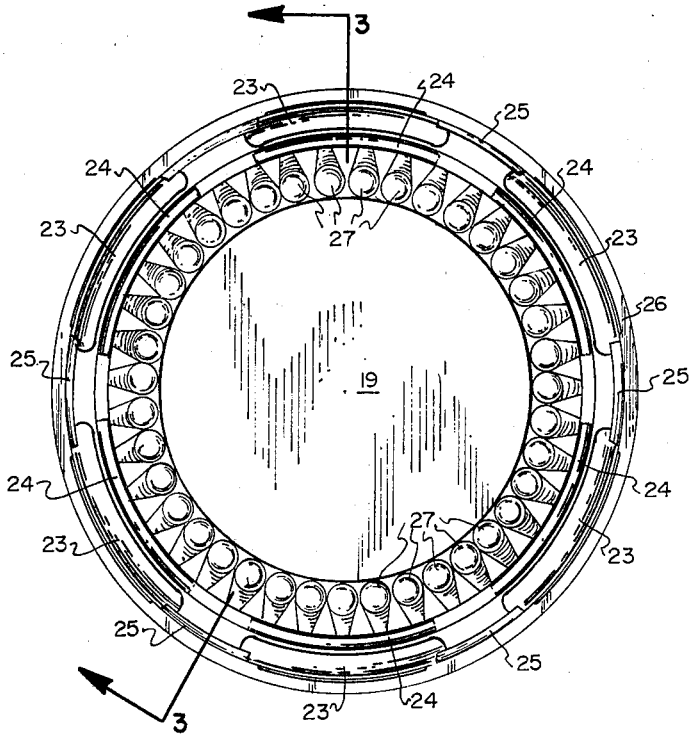
Figure 3:
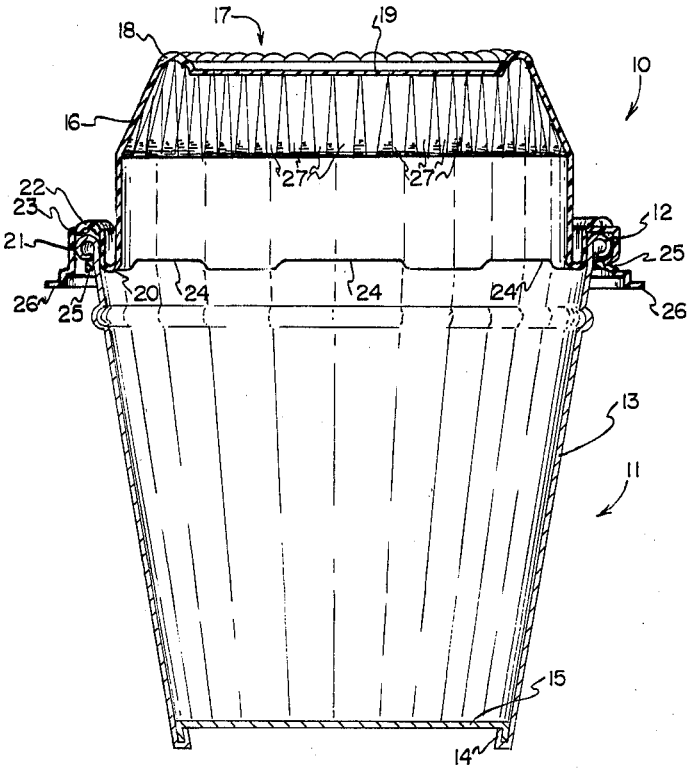
Figure 4:
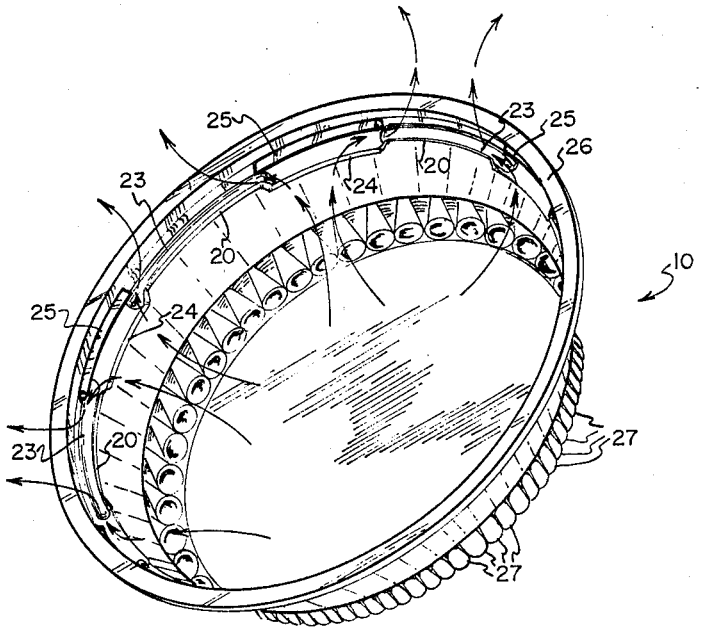

In the illustrated preferred embodiment, the lid of the invention, shown generally at 10, and made in one piece from a suitable strong, flexible material such as plastic, is adapted to be installed, as shown in FIGS. 1 and 3, on a bucket-type container 11.

The container 11 has a rolled, outwardly turned upper edge 12 defining a generally circular container mouth. A sidewall 13 extends downwardly from edge 12 to an inwardly rolled edge 14, on which there is positioned a flat bottom 15.

Lid 10 includes a peripheral sidewall 16 extending from a rim top shown generally as 17. A rim 18 formed at the top of wall 16 extends above and around a generally flat closure surface 19.

The edge of wall 16 opposite to rim 18 is formed to have an inner flange 20 and an outer flange 21. The inner flange is preferably formed by reversely turning the wall 16 and the outer flange 21 is formed by another reversal of the wall 16. The shoulder 22 formed between the inner and outer flanges 20 and 21 then has grooves 23 spaced therearound.

The inner flange 20 has notches 24 spaced therealong, and each end of a notch is aligned with the end of a groove 23 formed in the shoulder 22.

Inwardly projecting elongate bead members 25 are spaced around the outer flange 21 to engage the bottom surface at the rolled upper edge 12 of container 11 and to securely hold the lid to the container. The bead members the notches 24 but are shorter than the notches so that when the lid is installed on the container, steam will pass from inside the lid through the notches 24 to the ends thereof then into the grooves 23 and past the ends of bead members 25 before being vented to atmosphere along outer flange 21.

Outer flange 21 terminates in an outwardly flared rim 26 that is sufficiently spaced from the container 11 to allow fingers to be placed thereunder during removal from the lid 10 from container 11.

To provide strength to lid 10 and for decorative purposes, a portion of wall 16 is provided with side-by-side rolled pleats 27 that terminate at rim 18. The pleated configuration provides columnar strength to the sidewall and strengthens it against buckling as the lid installed, handled and used as a support for other items stacked thereon.

The lid 10 when removed from the container 11 and inverted, conveniently provides a serving dish for the food plased in the container.

As noted, wall 16 flares outwardly from flat surface 19 so that when the lid is placed on container 11 with the bead members 25 resting on the top of the container edge, pressure applied to the flat surface 19 or to the rim 18 will cam the wall 16 outwardly to permit the bead members to groove over the edge 12 and engage the bottom surface of the edge 12. At the same time, the inner flange 20 is fitted tightly against the inner surface of the edge 12. If the sidewall of the container is deformed, as it may be by a person carrying the container, the inner flange 20 and the bead member 25 remain in contact with the edge 12 to deform the lid in conformance with the deformation of the container. The lid, therefore, does not separate from the container as the container is handled.

The lid 10 is removed from container 11 by inserting fingers beneath the flange 26 in the area of a bead member 25 and prying out and up (when the lid is above the container). Generally, such prying action must occur adjacent two of the bead members before the lid will readily separate from the container. Thus, while the lid is readily installed on the container merely by positioning it and applying a slight central pressure, it is much more difficult to remove. Accordingly, very little time and effort is required to protect food items packaged in the container, but the items remain protected until a deliberate effort is made to remove the lid.

Although a preferred form of my invention has been herein disclosed, the present disclosure is made by way of example and variations are possible without departing from the subject matter coming within the scope of the following claims, which subject matter I regard as my invention.

I claim:

1. A one-piece lid for a container comprising a flat closure surface;

a wall flaring outwardly from said flat closure surface whereby said flat base surface and said wall form a dish, said wall terminating in an inner flange and an outer flange spaced from but connected to said inner flange;

bead members spaced around the outer flange and projecting inwardly therefrom;

notches formed in the inner flange, said notches having a length greater than the bead members and being spaced oppositely therefrom;

a shoulder interconnecting the inner and outer flange members;

grooves formed in the shoulder interconnecting the inner and outer flange members, said grooves extending beyond the adjacent ends of the adjacent notches and bead members; and a flared rim extending outwardly from the outer flange to provide finger gripping means for removal of the lid from a container.

* * * * *